US011242774B2

(12) United States Patent
Hattiangadi et al.

(10) Patent No.: US 11,242,774 B2
(45) Date of Patent: Feb. 8, 2022

(54) ROCKER ASSEMBLY WITH A HYDRAULIC LASH ADJUSTER

(71) Applicant: Caterpillar Inc., Peoria, IL (US)

(72) Inventors: Ashwin A. Hattiangadi, Edwards, IL (US); Charles F. Coffey, Peoria, IL (US); Chris I. Brown, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 55 days.

(21) Appl. No.: 16/577,171

(22) Filed: Sep. 20, 2019

(65) Prior Publication Data

US 2021/0087950 A1 Mar. 25, 2021

(51) Int. Cl.
*F01L 1/24* (2006.01)
*F01L 1/18* (2006.01)
*F01L 1/047* (2006.01)

(52) U.S. Cl.
CPC ..... *F01L 1/2411* (2013.01); *F01L 1/18* (2013.01); *F01L 1/047* (2013.01); *F01L 2001/2444* (2013.01)

(58) Field of Classification Search
CPC . F01L 1/2411; F01L 1/18; F01L 1/047; F01L 2001/2444
USPC ..... 123/90.46
See application file for complete search history.

(56) References Cited

U.S. PATENT DOCUMENTS 4,132,196 A * 1/1979 Wherry ..... F01L 1/181 123/90.36
4,523,551 A 6/1985 Arai et al.
4,616,607 A 10/1986 Kodama et al.
4,662,323 A * 5/1987 Moriya ..... F01L 1/053 123/90.23
5,394,842 A 3/1995 Kobayashi
5,584,268 A 12/1996 Natkin et al.
5,865,159 A * 2/1999 Henrikson ..... F01L 1/18 123/508
6,439,195 B1 * 8/2002 Warner ..... F02D 13/04 123/321
8,434,451 B2 5/2013 Yoon et al.
8,844,488 B2 9/2014 Kawahara
9,488,076 B2 * 11/2016 Young ..... B23P 6/00
10,132,206 B1 * 11/2018 Hattiangadi ..... F01L 1/26
(Continued)

FOREIGN PATENT DOCUMENTS

DE 102010018208 10/2011
WO 2018025149 A1 8/2018

*Primary Examiner* — Devon C Kramer
*Assistant Examiner* — Kelsey L Stanek
(74) *Attorney, Agent, or Firm* — Calfee, Halter & Griswold LLP

(57) ABSTRACT

A rocker assembly including a rocker shaft having an outer surface, main oil passage, a first radial passage and a second radial and a rocker arm having a first end and an inner cylindrical surface defining a bore, wherein the rocker shaft is received in the bore to pivotably mount the rocker arm onto the rocker shaft. The rocker arm includes a hydraulic lash adjuster mounted within the first end and a first oil passage having an inlet at the inner cylindrical surface and an outlet in fluid communication with the hydraulic lash adjuster. The inner cylindrical surface is spaced apart from the outer surface of the rocker shaft by a radial clearance, and wherein an inlet to the first oil passage and a first outlet of the first radial passage are in a loaded region of the radial clearance.

17 Claims, 4 Drawing Sheets

(56) References Cited

U.S. PATENT DOCUMENTS

| | | | | |
|---|---|---|---|---|
| 10,247,064 | B2 | 4/2019 | Cecur | |
| 2012/0048232 | A1* | 3/2012 | Meistrick | F01L 1/18 123/321 |
| 2013/0269653 | A1* | 10/2013 | Yang | F01L 1/20 123/323 |
| 2014/0283774 | A1* | 9/2014 | Langewisch | F01L 1/14 123/90.33 |
| 2018/0334930 | A1* | 11/2018 | Hattiangadi | F01L 13/06 |
| 2019/0145289 | A1* | 5/2019 | Ferreira | F01L 1/181 123/90.55 |
| 2019/0257219 | A1* | 8/2019 | Rivellini | F01L 1/2411 |

* cited by examiner

ROCKER ASSEMBLY WITH A HYDRAULIC LASH ADJUSTER

TECHNICAL FIELD

This disclosure relates to a rocker arm assembly for an engine, and in particular, to a rocker arm assembly having a hydraulic lash adjuster.

BACKGROUND

Internal combustion engines typically utilize valve actuation systems to control the flow of fuel and air to one or more combustion chambers during operation. Valve actuation system may include a variety of components, such as for example, one or more rotating camshafts, cam followers, push rods, rocker arms, and other elements disposed in a valvetrain to transfer the motion from the camshaft to the valves. Lash adjustment features are typically provided on valve actuation systems to elimination lash, which is the mechanical clearance between valvetrain components.

One type of lash adjustment feature is a hydraulic lash adjuster ("HLA"). HLAs typically includes mechanical components that cooperate to expand under hydraulic pressure to eliminate lash during one portion of the valve cycle, typically when the valvetrain is under low load or unloaded, and then assume a hydraulically "locked" or incompressible state during another portion of the valve cycle, typically when the valvetrain is under high load.

In engines that have valve actuation systems that do not include HLAs, it may be desirable to retrofit the engine with a valve actuation system that incorporates HLAs. HLAs may be incorporated, for example, in the rocker arm design. U.S. Pat. No. 4,523,551, to Arai et al., for example, discloses a valve actuating device for an internal combustion engine having a cam and a valve stem that includes a hydraulic valve lifter slidably disposed in the end of a rocker arm, a hollow rocker arm shaft pivotally supporting the rocker arm, a first fluid supply passage formed in the rocker arm shaft, a second fluid supply passage formed in the rocker arm to supply the hydraulic valve lifter with oil.

Adopting HLAs into a valve actuation system of an engine that originally does not include HLAs, however, may require expensive components of the engine system, such as the camshaft and oil pump, to be replaced. For example, HLAs typically require high oil pressure at their input location to enable effective functioning of the HLA. Further, engine oil system pressure typically drops when HLAs are adopted in the valve actuation system. Thus, the current oil pump may be insufficient and may need to be replaced by a higher capacity pump.

SUMMARY

In accordance with one aspect of the present disclosure a rocker assembly for an internal combustion engine includes a rocker shaft and a rocker arm. The rocker shaft includes an outer surface, a longitudinally extending main oil passage, a first radial passage extending from the main oil passage to a first outlet at the outer surface, and a second radial passage extending from the main oil passage to a second outlet at the exterior surface. The rocker arm includes a first end, a second end opposite the first end, and an inner cylindrical surface defining a bore that is positioned between the first end and the second end. The rocker shaft is received in the bore to pivotably mount the rocker arm onto the rocker shaft and the rocker arm includes a hydraulic lash adjuster mounted within the first end and a first oil passage having an inlet at the inner cylindrical surface and an outlet in fluid communication with the hydraulic lash adjuster. The inner cylindrical surface of the rocker arm is spaced apart from the outer surface of the rocker shaft by a radial clearance, and wherein the inlet to the first oil passage in the rocker arm and the first outlet of the first radial passage of the rocker shaft are in a loaded region of the radial clearance.

In accordance with another aspect of the present disclosure, a valve actuation system for an internal combustion engine includes a camshaft rotatably mounted within the engine and a rocker arm having a first end, a second end opposite the first end, an inner cylindrical surface defining a bore that is positioned between the first end and the second end, a hydraulic lash adjuster mounted within the first end and a first oil passage having an inlet at the inner cylindrical surface and an outlet in fluid communication with the hydraulic lash adjuster, wherein the second end is configured to receive a driving force from the camshaft. The valve actuation system further includes one or more engine valves reciprocally mounted within the engine wherein the first end of the rocker arm is operatively coupled to the engine valves and a rocker shaft received in the bore to pivotably mount the rocker arm onto the rocker shaft. The rocker shaft has an outer surface, a longitudinally extending main oil passage, a first radial passage extending from the main oil passage to a first outlet at the outer surface, and a second radial passage extending from the main oil passage to a second outlet at the exterior surface. The inner cylindrical surface of the rocker arm is spaced apart from the outer surface of the rocker shaft by a radial clearance, and the inlet to the first oil passage in the rocker arm and the first outlet of the first radial passage of the rocker shaft are in a loaded region of the radial clearance.

In accordance with another aspect of the present disclosure, a method of retrofitting hydraulic valve adjusters into a valve actuation system of an engine, wherein the engine includes a first set of rocker arms, a first set of rocker shafts, a first camshaft, and a first engine oil pump. Is disclosed. The method includes replacing the first set of rocker arms and the first set of rocker shafts with a set of retrofit rocker arms and a set of retrofit rocker shafts, while retaining the first camshaft and the first engine oil pump in the engine for use with the set of retrofit rocker arms and the set of retrofit rocker shafts. The rocker shaft includes an outer surface, a longitudinally extending main oil passage, a first radial passage extending from the main oil passage to a first outlet at the outer surface, and a second radial passage extending from the main oil passage to a second outlet at the exterior surface. The rocker arm includes a first end, a second end opposite the first end, and an inner cylindrical surface defining a bore that is positioned between the first end and the second end. The rocker shaft is received in the bore to pivotably mount the rocker arm onto the rocker shaft and the rocker arm includes a hydraulic lash adjuster mounted within the first end and a first oil passage having an inlet at the inner cylindrical surface and an outlet in fluid communication with the hydraulic lash adjuster. The inner cylindrical surface of the rocker arm is spaced apart from the outer surface of the rocker shaft by a radial clearance, and wherein the inlet to the first oil passage in the rocker arm and the first outlet of the first radial passage of the rocker shaft are in a loaded region of the radial clearance.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

While the present disclosure describes certain embodiments of a rocker arm assembly used in a valve actuation system for an internal combustion engine, the present disclosure is to be considered exemplary and is not intended to be limited to the disclosed embodiments. Also, certain elements or features of embodiments disclosed herein are not limited to a particular embodiment, but instead apply to all embodiments of the present disclosure.

Figure 1:
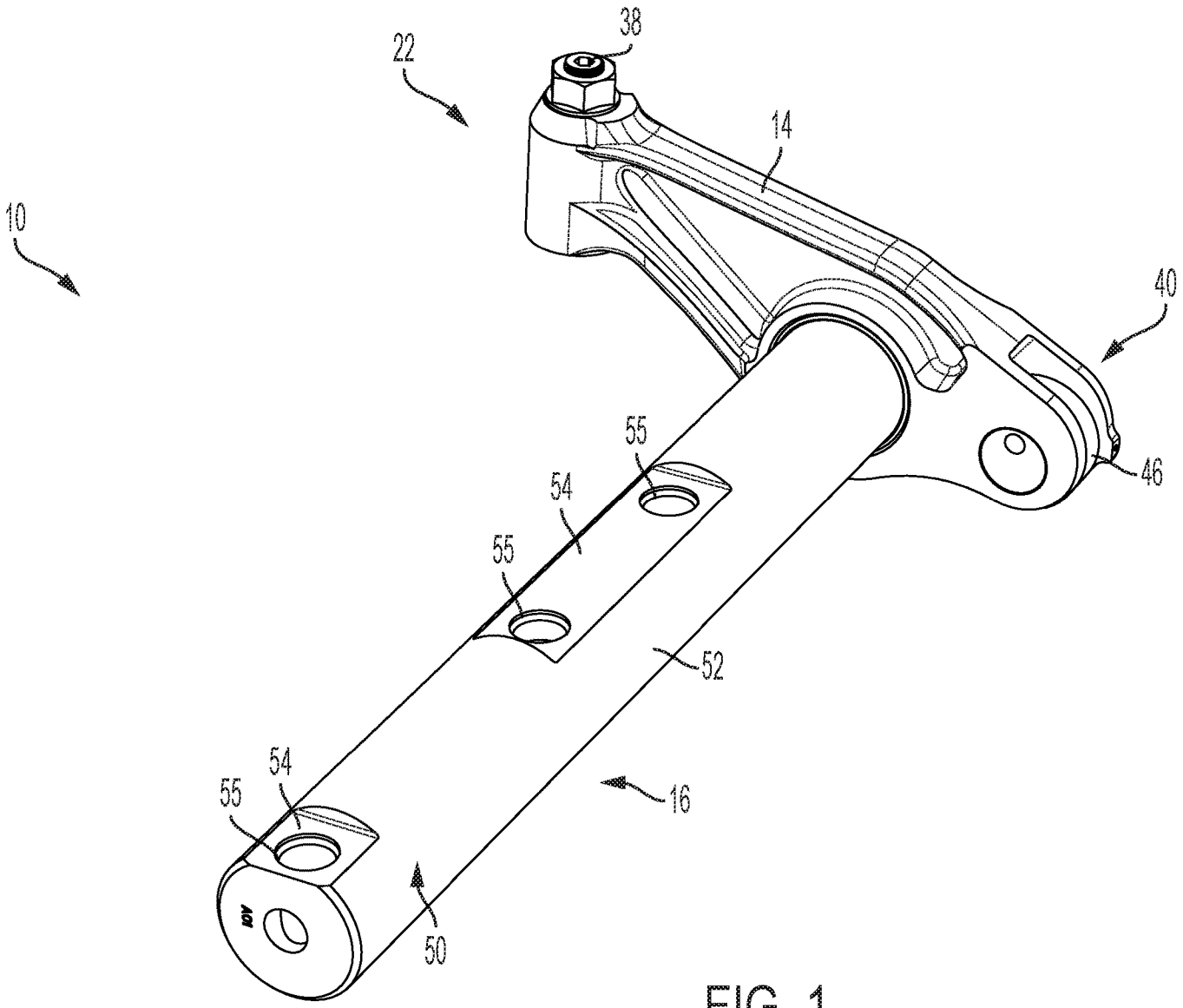
FIG. 1 is a perspective view of a portion of an exemplary embodiment of a valve actuation assembly, showing a rocker arm and a rocker shaft.
Figure 2:
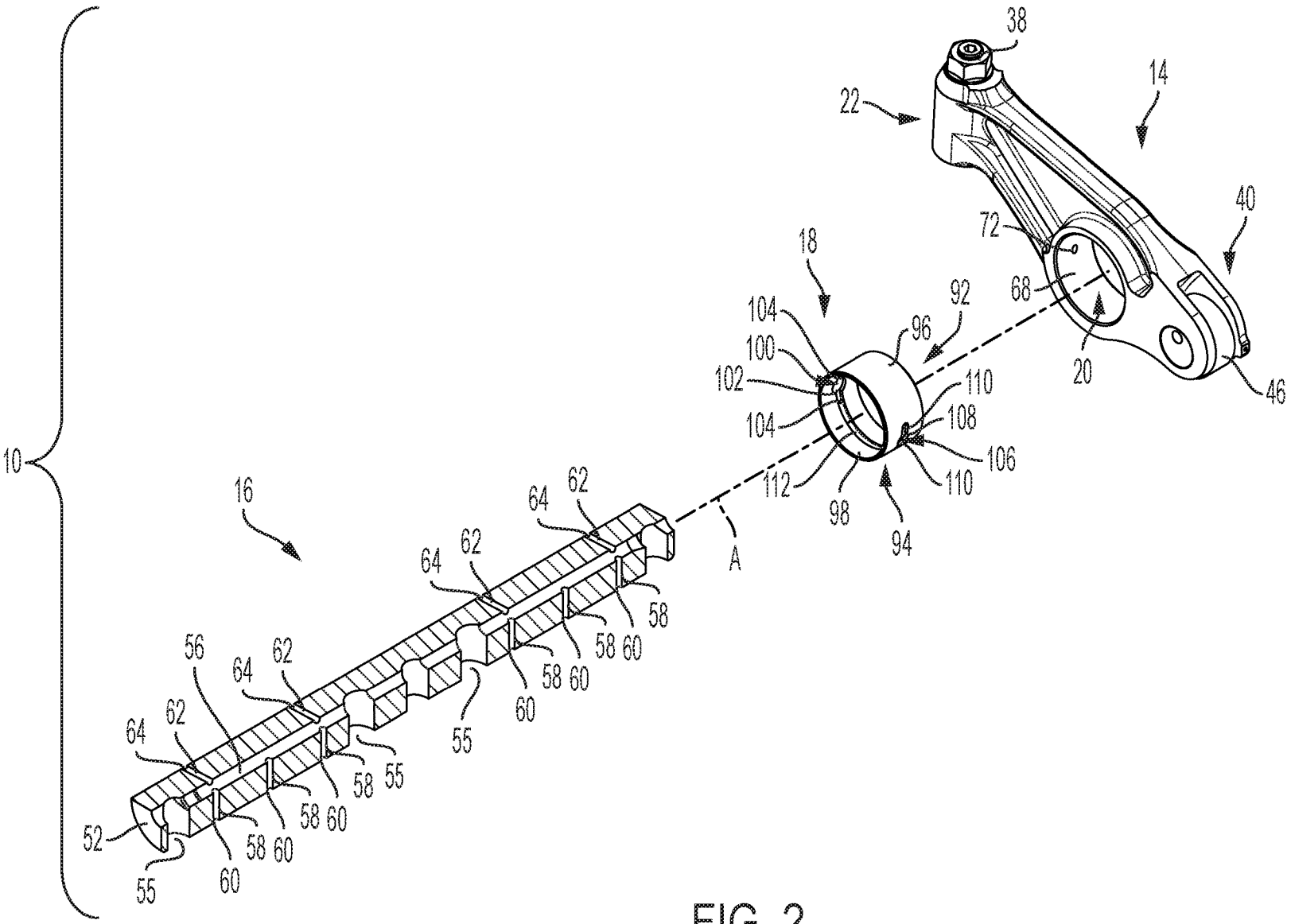
FIG. 2 is a partial exploded and partial sectioned view of the portion of the valve actuation assembly of FIG. 1.
Figure 3:
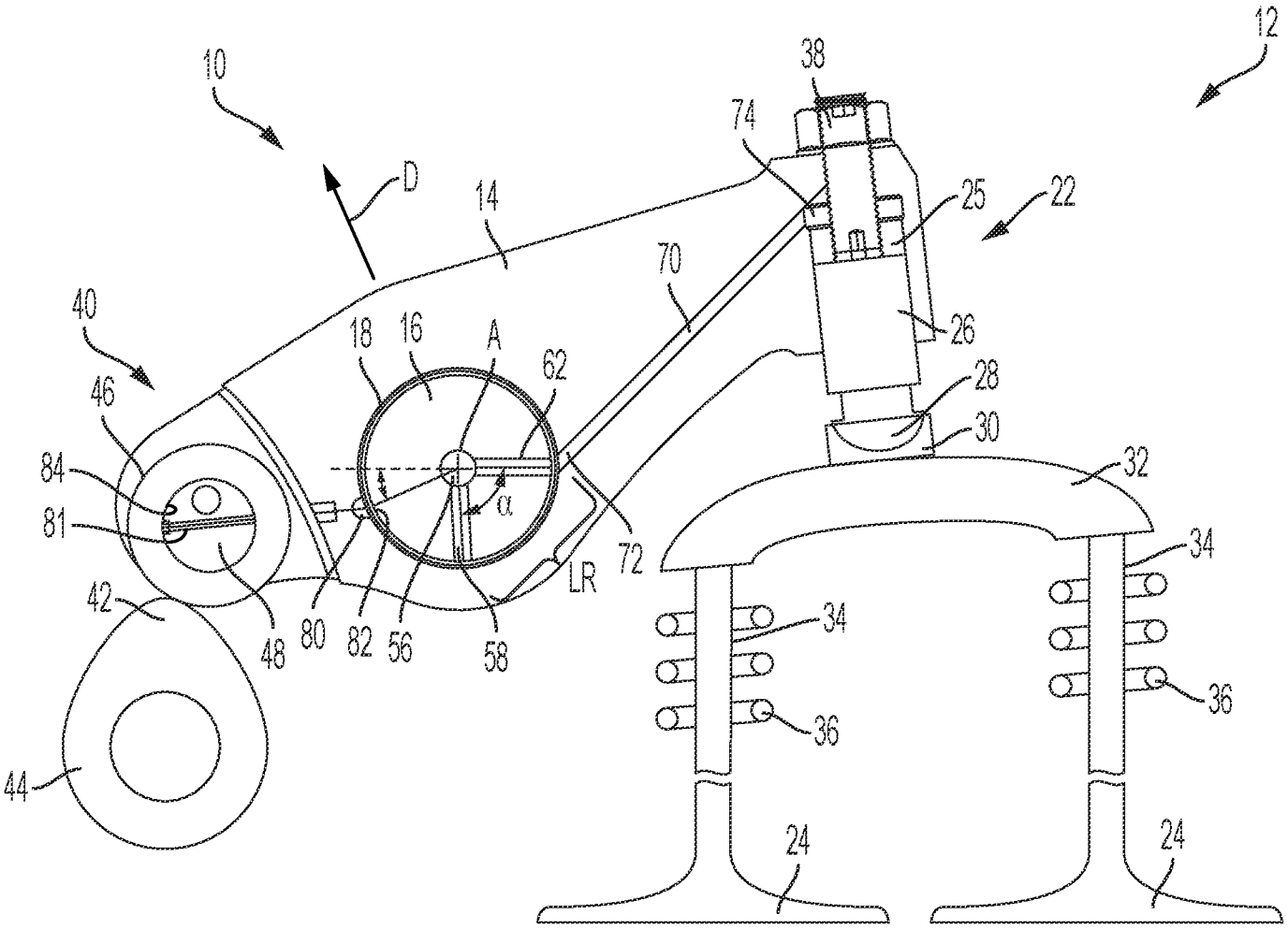
FIG. 3 is a side section view of the rocker arm and rocker shaft.
Figure 4:
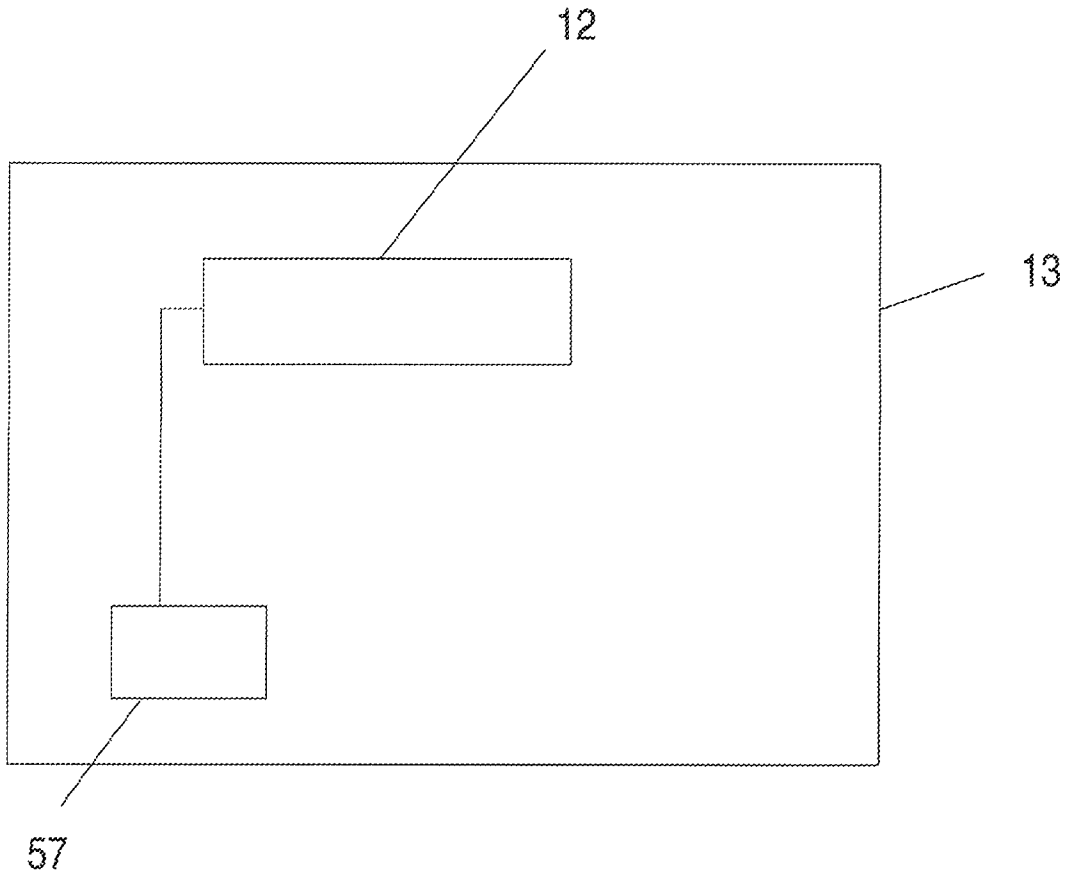
FIG. 4 is a schematic diagram of an engine.

FIGS. 1-4 illustrate an exemplary embodiment of rocker assembly 10 for a valve actuation system 12 of an internal combustion engine 13 (FIG. 4). The valve actuation system 12 illustrated in FIG. 3 is for an over-head cam type internal combustion engine. In other embodiments, however, the valve actuation system 12 could be configured for use in other style engines, such as pushrod type engine, for example. The rocker assembly 10 may be configured in a variety of ways. In the illustrated embodiment, the rocker assembly 10 includes a rocker arm 14, a rocker shaft 16, and a bushing 18 disposed between the rocker arm 14 and the rocker shaft 16. The rocker arm 14 is pivotably mounted on the rocker shaft 16 via a bore 20 in the rocker arm 14. The bushing 18 is seated in the bore 20 for movement with the rocker arm 14.

As shown in FIG. 3, the rocker arm 14 includes a first end 22 that is operatively coupled with a pair of engine valves 24. The first end 22 includes an internal cavity 25 housing a hydraulic lash adjuster 26. The hydraulic lash adjuster 26 includes a pivot 28 that cooperates with a foot or pedestal 30 disposed on a valve bridge 32. The valve bridge 32 engages a pair of valve stems 34 associated with the pair of engine valves 24 to allow for rocker arm 14 to actuate the pair of engine valves 24 simultaneously. Each of the pair of engine valves 24 is biased upward by a valve spring 36 to a closed position.

The hydraulic lash adjuster 26 can be any suitable hydraulic lash adjuster design. As is known in the art, the hydraulic lash adjuster 26 may include mechanical components (not shown) that cooperate to expand under hydraulic pressure to eliminate lash during one portion of the valve cycle, typically when the valvetrain is under low load or unloaded, and then assume a hydraulically "locked" or incompressible state during another portion of the valve cycle, typically when the valvetrain is under high load. In the illustrated embodiment, the rocker arm 14 includes an adjustment screw 38 configured to mechanically adjust the position of one or more components of the hydraulic lash adjuster 26.

The rocker arm 14 includes a second end 40 configured to receive a driving force from a cam lobe 42 on a camshaft 44 that is coupled with a crankshaft (not shown) of the engine. The second end 40 includes a roller 46 rotatably mounted within the second end 40. The roller 46 rollably engages the cam lobe 42 such that rotation of the camshaft 44 pivots the rocker arm 14 causing the engine valves 24 to open and close.

In the illustrated embodiment, the rocker shaft 16 is an elongated rod-like body 50 extending along a longitudinal axis A and having a cylindrical outer surface 52. The outer surface 52 includes a plurality of flat portions 54 having bolt holes 55 configured to receive mounting brackets and bolts (not shown) for bolting the rocker shaft 16 to a cylinder head (not shown) of the engine. Between the flat portions 54, the rocker shaft 16 is configured to pivotably mount one or more of the rocker arms 14. As shown in FIG. 2, the rocker shaft 16 includes a longitudinally-extending main oil passage 56 that is in fluid communication with an oil pump 57 on the engine 13 (FIG. 4) to receive pressurized oil from the pump.

In the illustrated embodiment, the rocker shaft 16 includes a plurality of spaced apart first radial oil passages 58. As illustrated in FIG. 2, the first radial oil passages 58 are straight, extend radially from, and perpendicular to, the main oil passage 56 and are illustrated as being arranged vertically or downwardly-extending in FIG. 2. In other embodiments, however, the first radial oil passages 58 may be curved, angled relative to vertical, and/or not perpendicular to the main oil passage 56. Each of the first radial oil passages 58 extends from the main oil passage 56 and includes a first outlet 60 at the cylindrical outer surface 52.

The rocker shaft 16 also includes a plurality of spaced apart second radial oil passages 62. As illustrated in FIG. 2, the second radial oil passages 62 are straight, extend radially from, and perpendicular to, the main oil passage 56, and are illustrated as arranged horizontally or laterally-extending. In other embodiments, however, the second radial oil passages 62 may be curved, angled relative to horizontal, and/or not perpendicular to the main oil passage 56.

In the illustrated embodiment, each of the second radial oil passages 62 is coplanar with a corresponding first radial oil passage 58 and extends at an angle $\alpha$ relative to the corresponding first radial oil passage 58, as shown in FIG. 3. In some embodiments, the angle $\alpha$ is in the range of about 80 degrees to about 100 degrees, or about 85 degrees to about 95 degrees, or about 90 degrees. In other embodiments, however, the angle $\alpha$ may be less than 80 degrees or greater than 100 degrees. Each of the second radial oil passages 62 extends from the main oil passage 56 and includes a second outlet 64 at the cylindrical outer surface 52.

The rocker arm 14 is configured to route pressurized oil received from the main oil passage 56 of the rocker shaft 16 to the hydraulic lash adjuster 26 positioned in the first end 22 of the rocker arm 14 and to the roller 46 mounted in the second end 40 of the rocker arm 14. The bore 20 for mounting the rocker arm 14 onto the rocker shaft 16 is defined by a cylindrical inner side surface 68, as shown in FIG. 2. The roller 46 is rollably mounted onto an axle 48 in the second end 40.

Referring to FIG. 3, the rocker arm 14 includes a first oil passage 70 having a first inlet 72 in the inner side surface 68. The first oil passage 70 extends from the first inlet 72 to a top portion 74 of the cavity 25 to supply oil to the hydraulic lash adjuster 26. As shown in FIG. 3, the first oil passage 70 is straight and does not include any curves or bends, and thus provides a direct path to the hydraulic lash adjuster 26. In other embodiments, however, the first oil passage 70 may include one or more non-straight portions.

The rocker arm 14 includes a second oil passage 80 the extends from a second inlet 82 on the inner side surface 68 to a cross oil passage 81 in the axle 48. The cross oil passage 81 feeds oil to an inner surface 84 of the roller 46 to supply a layer of oil between the roller 46 and the axle 48 to reduce friction and allow the roller to rotate. In other embodiments, however, the roller 46 could be configured with roller bearings or other friction reducing means.

The bushing 18 may be configured in a variety of ways. Any suitable journal bearing, such as for example, a conventional journal bearing, may be used. In the illustrated embodiment, the bushing 18 includes an upper shell 92 and a lower shell 94 that form a cylindrical bearing having an outer surface 96 and an inner surface 98. The bushing 18 includes a first oil hole 100 extending from the inner side surface 68 to the outer surface 66. The first oil hole 100 is positioned at, or generally at, the intersection between the upper shell 92 and the lower shell 94. The first oil hole 100 in the illustrated embodiment includes a circular central portion 102 and a pair of radially-extending portions 104.

The bushing 18 includes a second oil hole 106 extending from the inner side surface 68 to the outer surface 66. The second oil hole 106 is configured similar to the first oil hole 100 and includes a circular central portion 108 and a pair of radially-extending portions 110. The first oil hole 100 and the second oil hole 106 are connected by a central oil groove 112 in the inner surface 98 of the lower shell 94. In one embodiment, the central oil groove 112 extends circumferentially around the bushing 18.

When the rocker assembly 10 is assembled, as shown in FIGS. 1 and 3 for example, the bushing 18 is installed in the bore 20 of the rocker arm 14 such that the circular central portion 102 of the first oil hole 100 is aligned with the first inlet 72 of the first oil passage 70 and the circular central portion 108 of the second oil hole 106 is aligned with the second inlet 82 of the second oil passage 80. In addition, the rocker arm 14 and the bushing 18 are mounted onto the rocker shaft 16 such that the first outlet 60 of one of the first radial oil passages 58 is aligned with the central oil groove 112 and the second outlet 64 of one of the second radial oil passages 62 opens into the first oil hole 100 and the first inlet 72 to the first oil passage 70 in the rocker arm 14.

INDUSTRIAL APPLICABILITY

While the exemplary embodiments of the rocker assembly 10 are illustrated as used in an overhead cam type engine, the rocker assemblies 10 may be used in other engine types, such as for example, pushrod-type engines. The rocker assembly 10 is configured with features that provide increased system oil pressure and reduced oil leakage as compared to conventional rocker assemblies. The increased oil system pressure and reduced oil leakage make the rocker assemblies particularly useful when used to retrofit the valve actuation system of an engine with hydraulic lash adjusters. Since HLAs typically require high oil pressure at their input location to enable effective functioning of the HLA and engine oil system pressure typically drops when HLAs are adopted in the valve actuation system, the increased oil system pressure and reduced oil leakage achieved by the rocker assemblies 10 according to the present disclosure, may allow adoption of HLAs in the valve actuation system without the need to install a larger capacity oil pump or replace the camshaft. The rocker assembly 10 is not limited to use in retrofit situations.

During operation, a circumferential gap, referred to as the radial clearance, exists between the inner surface 98 of the bushing 18 and the outer surface 52 of the rocker shaft 16. A layer of oil, fed from the main oil passage 56, is formed within the circumferential gap around the rocker shaft 16 to reduce friction between the pivoting rocker arm 14 and bushing 18 and the rocker shaft 16.

The forces applied to the valve actuation system, during operation, such as forces coming from the cam lobe 42, tend to bias the rocker arm 14 in a direction upward, as shown, generally, by the arrow D in FIG. 3. As a result, the radial clearance between the inner surface 98 of the bushing 18 and the outer surface 52 of the rocker shaft 16 is reduced in an area opposite the direction of arrow D. This region of smaller radial clearance, which is referred herein as the loaded region LR, results in higher oil pressure in this region as compare to other portions of the circumferential gap.

The rocker assembly 10 is configured such that the first outlet 60 of the first radial oil passage 58 is in the loaded region LR and the portion of the central oil groove 112 between the first outlet 60 of the first radial oil passage 58 and the first inlet 72 of the first oil passage 70 in the rocker arm 14 is entirely, or at least mostly, in the loaded region LR. For example, in the illustrated embodiment, the first outlet 60, the first inlet 72 of the first oil passage 70, and the central oil groove 112 extending therebetween are all in the loaded region LR. As a result, the rocker arm assembly 10 takes advantage of the tight radial clearance of the loaded region LR by directing oil from the main oil passage 56 into the loaded region LR via the by positioning the first outlet 60 of the first radial oil passage 58, the first inlet 72 of the first oil passage 70, and the central oil groove 112 extending therebetween in the loaded region LR, oil leakage of oil directed to the first oil passage 70 is minimized, which helps not only preserve oil pressure but minimizes oil leakage and hence increases rocker shaft oil pressure.

In an exemplary embodiment, in an unloaded state, the radial clearance between the outer surface 52 of the rocker shaft 16 and the inner surface 98 of the bushing 18 (i.e., not including the surfaces forming the groove 112) are in the range of about 25 microns to about 40 microns, or about 32.5 microns. When loaded, the radial clearance in the loaded region may be less than 15 microns, or less than 10 microns. For example, the radial clearance at, or proximate, the first outlet 60 of the first radial oil passage 58 may be in the range of about zero microns to about 8 microns, or about 5 microns, and the radial clearance at the first inlet 72 of the first oil passage 70 maybe in the range of about 5 microns to about 10 microns. The radial clearance extending between the first outlet 60 and the first inlet 70 is less than the radial clearance at the first inlet 72.

In addition to the utilizing the loaded region LR, the second outlet 64 of the second radial oil passage 62 of the rocker shaft 16 opens into the first oil hole 100 and the first inlet 72 to the first oil passage 70 in the rocker arm 14. Therefore, oil flow from the main oil passage 56 of the rocker shaft 16 flows into the first oil passage 70 in an uninterrupted, or mostly uninterrupted radial direction. In other words, the oil from the second radial oil passage 62 does not flow circumferentially around the bushing 18, such as through the central oil groove 112, to reach the first inlet 72 of the first oil passage 70. As a result, there is no, or minimal, oil pressure loss when oil flows from the second radial oil passage 62 into the first oil passage 70.

The HLA, therefore, may receive oil from the main oil passage 56 via both the first radial oil passage 58 and central oil groove 112 through the loaded region LR and into the first oil passage 70 and, more directly, via the straight second radial oil passage 62 directly into the straight first oil passage 70. Thus, the rocker assembly according to the present disclosure is able to provide oil to the HLA at sufficient pressure to enable proper function of the HLA without increasing the capacity of the oil pump.

In this respect, an engine having a valve actuation system that does not include HLAs may be retrofitted with rocker assemblies according to the present disclosure. For example, the set of rocker arms, rocker shafts, and bushings of the non-HLA valve actuation system may be replaced with the disclosed rocker assemblies 10. Thus, the rocker arms 14, the rocker shafts 16, and the bushings 18 would serve as retrofit rocker arms, retrofit rocker shafts, and retrofit bushings. In some embodiments, the rocker arms 14, the rocker shafts 16, and the bushings 18 may form a retrofit kit. Due to the features of the rocker assemblies 10 that provide increased system oil pressure and reduced oil leakage, the engine can be retrofitted with HLAs without the need to replace the current camshaft on the engine or replacing the current oil pump with an oil pump with increase capacity.

While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

LIST OF ELEMENTS

| Element Number | Element Name |
|---|---|
| 10 | rocker assembly |
| 12 | valve actuation system |
| 13 | engine |
| 14 | rocker arm |
| 16 | rocker shaft |
| 18 | bushing |
| 20 | bore |
| 22 | first end |
| 24 | engine valves |
| 25 | internal cavity |
| 26 | hydraulic lash adjuster |
| 28 | pivot |
| 30 | pedestal |
| 32 | valve bridge |
| 34 | valve stem |
| 36 | valve spring |
| 38 | adjustment screw |
| 40 | second end |
| 42 | cam lobe |
| 44 | camshaft |
| 46 | roller |
| 48 | axle |
| 50 | body |
| 52 | outer surface |
| 54 | flat portions |
| 55 | bolt holes |
| 56 | main oil passage |
| 57 | engine oil pump |
| 58 | first radial oil passages |
| 60 | first outlet |
| 62 | second radial oil passages |
| 64 | second outlet |
| 66 | outer surface |
| 68 | inner side surface |
| 70 | first oil passage |
| 72 | first inlet |
| 74 | top portion |

-continued

| Element Number | Element Name |
|---|---|
| 80 | second oil passage |
| 81 | cross oil passage |
| 82 | second inlet |
| 84 | inner surface |
| 92 | upper shell |
| 94 | lower shell |
| 96 | outer surface |
| 98 | inner surface |
| 100 | first oil hole |
| 102 | central portion |
| 104 | radially-extending portions |
| 106 | second oil hole |
| 108 | central portion |
| 110 | radially-extending portions |
| 112 | central oil groove |

What is claimed is:

1. A rocker assembly for an internal combustion engine, comprising:

a rocker shaft having an outer surface, a longitudinally-extending main oil passage, a first radial passage extending downwardly from the longitudinally-extending main oil passage to a first outlet at the outer surface, and a second radial passage extending laterally from the longitudinally-extending main oil passage to a second outlet at the outer surface; and a rocker arm having a first end, a second end opposite the first end, and an inner cylindrical surface defining a bore that is positioned between the first end and the second end, wherein the rocker shaft is received in the bore to pivotably mount the rocker arm onto the rocker shaft, the rocker arm including a hydraulic lash adjuster mounted within the first end and a first oil passage having an inlet at the inner cylindrical surface and an outlet in fluid communication with the hydraulic lash adjuster;

a bushing mounted in the bore between the inner cylindrical surface of the rocker arm and the outer surface of the rocker shaft, the bushing having an inner bushing surface and a first oil hole open to the second outlet of the second radial passage and the inlet to the first oil passage, wherein the inner bushing surface includes a groove configured to route oil from the first outlet of the first radial passage to the inlet of the first oil passage, wherein the inner bushing surface is spaced apart from the outer surface of the rocker shaft by a radial clearance that forms a circumferential gap between the inner bushing surface and the outer surface of the rocker shaft, and wherein at least one of the groove, the first outlet, and the first oil hole are located in a loaded region where the radial clearance is smaller, during operation, as compared to other portions of the circumferential gap.

2. The rocker assembly of claim 1, wherein the groove, the first outlet, and the first oil hole are located in the loaded region.

3. The rocker assembly of claim 1, wherein the first outlet is aligned with the groove.

4. The rocker assembly of claim 1, wherein the radial clearance in the loaded region is less than 15 microns.

5. The rocker assembly of claim 1, wherein the radial clearance at the first outlet is in the range of zero microns to 5 microns.

6. The rocker assembly of claim 1, wherein the second radial passage extends at an angle relative to the first radial passage in the range of 85 degrees to 95 degrees.

7. The rocker assembly of claim 1, wherein both the first outlet of the first radial passage and the second outlet of the second radial passage are in fluid communication with the inlet of the first oil passage.

8. The rocker assembly of claim 1, wherein the first radial passage extends vertically and the second radial passage extends horizontally such that the second radial passage extends at a 90 degree angle relative to the first radial passage.

9. A valve actuation system for an internal combustion engine, comprising:

a camshaft rotatably mounted within the engine;

a rocker arm having a first end, a second end opposite the first end, an inner cylindrical surface defining a bore that is positioned between the first end and the second end, a hydraulic lash adjuster mounted within the first end and a first oil passage having an inlet at the inner cylindrical surface and an outlet in fluid communication with the hydraulic lash adjuster, wherein the second end is configured to receive a driving force from the camshaft;

one or more engine valves reciprocally mounted within the engine, wherein the first end of the rocker arm is operatively coupled to the one or more engine valves;

a rocker shaft received in the bore to pivotably mount the rocker arm onto the rocker shaft, wherein the rocker shaft has an outer surface, a longitudinally-extending main oil passage, a first radial passage extending downwardly from the longitudinally-extending main oil passage to a first outlet at the outer surface, and a second radial passage extending laterally from the longitudinally-extending main oil passage to a second outlet at the outer surface; and a bushing mounted in the bore between the inner cylindrical surface of the rocker arm and the outer surface of the rocker shaft, the bushing having an inner bushing surface and a first oil hole open to the second outlet of the second radial passage and the inlet to the first oil passage, wherein the inner bushing surface includes a groove configured to route oil from the first outlet of the first radial passage to the inlet of the first oil passage, wherein the inner bushing surface is spaced apart from the outer surface of the rocker shaft by a radial clearance that forms a circumferential gap between the inner bushing surface and the outer surface of the rocker shaft, and wherein at least one of the groove, the first outlet, and the first oil hole are located in a loaded region where the radial clearance is smaller, during operation, as compared to other portions of the circumferential gap.

10. The valve actuation system of claim 9, wherein the groove, the first outlet, and the first oil hole are located in the loaded region.

11. The valve actuation system of claim 9, wherein the first outlet is aligned with the groove.

12. The valve actuation system of claim 9, wherein the second radial passage extends at an angle relative to the first radial passage in the range of 85 degrees to 95 degrees.

13. The valve actuation system of claim 9, wherein the radial clearance in the loaded region is less than 15 microns.

14. The valve actuation system of claim 9, wherein the radial clearance at the first outlet is in the range of zero microns to 5 microns.

15. The valve actuation system of claim 9, wherein both the first outlet of the first radial passage and the second outlet of the second radial passage are in fluid communication with the inlet of the first oil passage.

16. The valve actuation system of claim 9, wherein the first radial passage extends downward from the longitudinally-extending main oil passage in a direction toward the one or more engine valves.

17. The valve actuation system of claim 9, wherein the first radial passage extends vertically and the second radial passage extends horizontally such that the second radial passage extends at a 90 degree angle relative to the first radial passage.

* * * * *